US006848591B2

(12) United States Patent
Kiel et al.

(10) Patent No.: US 6,848,591 B2
(45) Date of Patent: Feb. 1, 2005

(54) TRAY-SHAPE PACKAGING

(75) Inventors: Hans-Richard Kiel, Oyten (DE); Bernard De Turckheim, Olivet (FR)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 10/204,893

(22) PCT Filed: Feb. 19, 2001

(86) PCT No.: PCT/DE01/00642

§ 371 (c)(1),
(2), (4) Date: Jan. 29, 2003

(87) PCT Pub. No.: WO01/62622

PCT Pub. Date: Aug. 30, 2001

(65) Prior Publication Data

US 2003/0155362 A1 Aug. 21, 2003

(30) Foreign Application Priority Data

Feb. 21, 2000 (DE) ..... 100 09 103

(51) Int. Cl.[7] ..... B65D 41/00
(52) U.S. Cl. ..... 220/359.1; 220/657; 220/658

(58) Field of Search ..... 220/359.1, 657, 220/658, 659, 650, 656, 359.2, 359.4

(56) References Cited

U.S. PATENT DOCUMENTS

| | | | | | |
|---|---|---|---|---|---|
| 4,211,338 | A | * | 7/1980 | Bublitz | 220/359.4 |
| 4,438,850 | A | * | 3/1984 | Kahn | 229/123.1 |
| 4,540,105 | A | * | 9/1985 | Wright | 220/359.2 |
| 4,693,391 | A | * | 9/1987 | Roth | 220/359.2 |
| 4,715,528 | A | * | 12/1987 | Kjelgaard et al. | 229/123.1 |
| 4,865,217 | A | * | 9/1989 | Yoshimoto | 220/266 |

FOREIGN PATENT DOCUMENTS

EP 0273383 * 7/1988

* cited by examiner

*Primary Examiner*—Joseph Man-Fu Moy
(74) *Attorney, Agent, or Firm*—Fulbright & Jaworski LLP

(57) ABSTRACT

Tray-like pack with a sealing rim passing round the removal opening for sealing on a sealing foil or film and a rolling rim radially outwardly connected to said sealing rim and at least in a partial area the rolling rim has a smaller height than in the remaining area.

5 Claims, 1 Drawing Sheet

TRAY-SHAPE PACKAGING

TECHNICAL FIELD

The invention relates to a tray-like pack with a sealing rim passing round the removal opening for sealing on a sealing foil or film and a rolling rim radially outwardly connected to said sealing rim.

BACKGROUND OF THE INVENTION

Such tray packs are conventionally used in the food industry, particularly for smaller pet food portions. The filled tray pack is tightly sealed by sealing a sealing foil onto a sealing rim passing round the removal opening. To permit an opening of the pack by drawing off the sealing foil, conventionally in a partial area, e.g. in the case of a polygonal tray in one of the corners, is formed an opening tag projecting radially outwards over the sealing rim and a rolling rim connecting onto the same. The tag defines a tear initiation point for pulling off the sealing foil.

In conventional tray packs the top of the rolling rim projects over and beyond the sealing rim plane. On sealing on the sealing foil, as a result of the counterpressure of the rolling rim, a deformation occurs in the tag area thereof and consequently in said area a stronger connection of the sealing foil to the tray pack. Thus, in the tag area an increased tear initiation force occurs on opening the pack, which is undesired particularly for user convenience reasons.

Therefore the problem of the present invention is to provide such a tray pack which can be opened with reduced force expenditure.

BRIEF SUMMARY OF THE INVENTION

According to the invention, this problem is solved in that, at cast in a partial area, the rolling rim has a smaller height than in the remaining area.

Preferably, the top of the rolling rim in said partial area does not project over the sealing rim plane.

In a particularly preferred embodiment, the invention proposes that the top of the rolling rim, relative to the sealing rim plane, drops away downwards in said partial area.

Particular preference is given to an embodiment in which an opening tag of the sealing foil is located in said partial area.

As a result of the measures proposed by the invention in a surprisingly simple manner there is a significant reduction to the tear initiation force from the opening tag on drawing off the sealing foil. Even a slight lowering of the top of the rolling rim in said partial area leads to an improvement. Particularly favourable results arc obtained if the top of the rolling rim in said partial area does not project over the sealing rim plane or even drops away downwards.

BRIEF DESCRIPTION OF THE DRAWINGS

A preferred embodiment of the invention is described hereinafter relative to the attached drawings, wherein show.

DETAILED DESCRIPTION OF THE INVENTION

Figure 1:
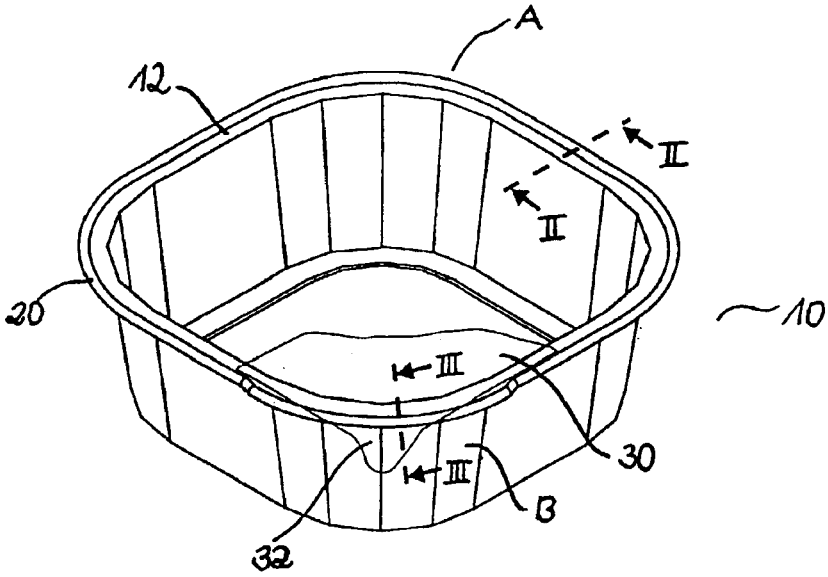
FIG. 1 is a perspective view of a tray pack according to the invention.

FIG. 1 shows a typical tray pack 10 for pet foods, here in rectangular form. It is pointed out that the invention is suitable for all conceivable geometrical shapes of tray packs, including circular, symmetrical or asymmetrical polygonal.

Figure 2:
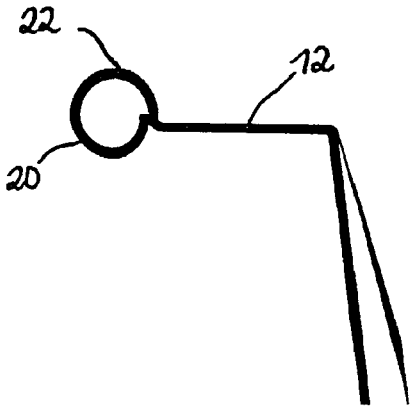
FIG. 2 is a partial cross-section along line II—II in the partial area A of the rolling rim.

Around the removal opening of the tray pack 10 is provided a sealing rim 12 for sealing on an only partly shown sealing foil or film 30. A rolling rim 20 typical for such packs is radially outwardly connected to said sealing rim 12. In the partial area A representing most of the circumference of the tray pack 10 the rolling rim is constructed in conventional manner so that its top 22 projects over the plane of the sealing rim 12 (FIG. 2).

Figure 3:
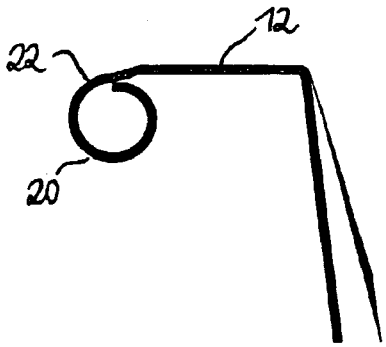
FIG. 3 is a partial cross-section along line III—III in the lowered partial area B of the rolling rim.

According to the invention, in a smaller partial area B, which essentially coincides with the area of the sealing foil 30 in which the opening tag 32 is formed, a smaller partial area B is lowered. In FIG. 3 is shown the embodiment in which the top 22 of the rolling rim 20, relative to the plane of the sealing rim 12, drops away downwards.

On sealing the sealing foil 30 onto the sealing rim 12 the pressure of the rolling rim 20 in partial area B is consequently significantly reduced or in the preferred embodiment shown eliminated, so that the tear initiation force on pulling off the sealing foil 30 for opening the pack is significantly reduced.

No great significance is attached to the material chosen for the tray pack or the sealing foil or film, because the object of the invention can be achieved with any standard material combination.

The features of the invention disclosed n the above description, drawings and claims can be essential to the implementation of the various embodiments of the invention, either singly or in random combination.

What is claimed is:

1. A tray-like pack comprising:

a sealing rim passing round a removal opening for sealing foil;

a rolling rim connected radially outwards to said sealing rim, said rolling rim projecting over a plane of the sealing rim;

wherein at least in a partial area of said sealing rim, the rolling rim drops away downwards of the plane of the sealing rim.

2. The pack according to claim 1, wherein in the partial area, the top of the rolling rim does not project over the plane of the sealing rim.

3. The pack according to claim 2, wherein in the partial area of said sealing rim, the rolling rim has a smaller height than in the remaining area.

4. The pack according to claim 1, wherein an opening tag of the sealing foil is located in the partial area.

5. The pack according to claim 1, wherein the shape of the tray-like pack is selected from a group consisting of rectangular, circular, symmetrical and asymmetrical polygonal shapes.

* * * * *